US011828069B2

(12) United States Patent
Schlatter

(10) Patent No.: US 11,828,069 B2
(45) Date of Patent: Nov. 28, 2023

(54) CABLE TENSIONING SYSTEM FOR RAILINGS AND BARRIERS

(71) Applicant: Daniel J. Schlatter, Warsaw, IN (US)

(72) Inventor: Daniel J. Schlatter, Warsaw, IN (US)

( * ) Notice: Subject to any disclaimer, the term of this patent is extended or adjusted under 35 U.S.C. 154(b) by 333 days.

(21) Appl. No.: 17/193,472

(22) Filed: Mar. 5, 2021

(65) Prior Publication Data

US 2021/0277663 A1 Sep. 9, 2021

Related U.S. Application Data

(60) Provisional application No. 62/985,993, filed on Mar. 6, 2020.

(51) Int. Cl.
*E04F 11/18* (2006.01)

(52) U.S. Cl.
CPC ..... *E04F 11/1859* (2013.01)

(58) Field of Classification Search
CPC ..... E04H 17/04; E04H 17/06; E04H 17/10; E04H 17/12; E04H 17/124; E04H 17/266; E04F 11/18; E04F 11/181; E04F 11/1859; E04F 2011/1823; E04F 2011/1825; E04F 2011/1827
See application file for complete search history.

(56) References Cited

U.S. PATENT DOCUMENTS 4,190,234 A * 2/1980 Coleman ..... E04H 17/10 254/232
4,730,809 A * 3/1988 Stoler ..... E04H 17/127 200/61.93
6,135,424 A * 10/2000 Bracke ..... E04H 17/1417 256/65.01
7,889,075 B2 * 2/2011 Winkler ..... G08B 13/122 340/541
9,689,410 B2 * 6/2017 Østervig ..... E04H 17/24
9,976,320 B2 * 5/2018 Burt ..... E04H 17/1417
2005/0133771 A1 * 6/2005 Kohler ..... F16G 11/12 254/232
2006/0151760 A1 * 7/2006 Vyvyan-Vivian ..... E04H 17/127 254/231
2009/0050865 A1 * 2/2009 Napier ..... E04F 11/1853 256/37
2010/0012910 A1 * 1/2010 Napier ..... E04F 11/1859 256/34
2012/0168703 A1 * 7/2012 Napier ..... E04F 11/1842 256/37

* cited by examiner

*Primary Examiner* — Jonathan P Masinick
(74) *Attorney, Agent, or Firm* — Bailey Legal Services, PLLC

(57) ABSTRACT

The present disclosure is directed to cable tensioning systems for use in railings and barriers. The cable tensioning assembly can be used in railings and barriers that utilize vertical or horizontal cables. The present assembly includes a tension bar which runs along the rails of the railing system and has a plurality of equidistant pairs of apertures. Each pair of apertures secures an end of a cable and accepts a tension adjuster. The tension adjuster of one embodiment threadably engages with the rail to pull the tension bar close to the rail and apply tension to the cable. The tension adjuster of another embodiment threadably engages with the tension bar to push the tension bar closer to the rail and apply tension to the cable.

25 Claims, 14 Drawing Sheets

CABLE TENSIONING SYSTEM FOR RAILINGS AND BARRIERS

CROSS-REFERENCE TO RELATED APPLICATIONS

The present application claims priority to U.S. Provisional Application No. 62/985,993 filed Mar. 6, 2020, the complete disclosure of which is hereby expressly incorporated by reference herein.

BACKGROUND

1. Technical Field

The present application relates to a cable tensioning assembly for use in cable railings for interior and/or exterior walkways and staircases.

2. Description of the Related Art

Cable railings are used on interior and exterior walkways and staircases to create barriers. Many cable railings use metal cable strung under tension between and/or through posts to create such a barrier. Cable railings may be used with metal, wood, and other posts.

Cable railings use a variety of methods to install and tension the cable between terminal posts and through intermediate posts.

SUMMARY

The present disclosure is directed to cable tensioning systems for use in railings and barriers. The cable tensioning assembly can be used in railings and barriers that utilize vertical or horizontal cables. The present assembly includes a tension bar which runs along the rails of the railing system and has a plurality of equidistant pairs of apertures. Each pair of apertures secures an end of a cable and accepts a tension adjuster. The tension adjuster of one embodiment threadably engages with the rail to pull the tension bar close to the rail and apply tension to the cable. The tension adjuster of another embodiment threadably engages with the tension bar to push the tension bar closer to the rail and apply tension to the cable.

An embodiment of the present cable tensioning system for railings and barriers includes a rail, a tension bar including a cable mounting portion having an adjuster aperture and a cable aperture a cable, disposed within the cable aperture of the cable mounting portion, and a tension adjuster disposed within the adjuster aperture of the cable mounting portion and configured to urge the tension bar towards the rail.

According to another embodiment of the present disclosure, a cable tension assembly is provided which includes a rail, a tension bar including a cable mounting portion having an adjuster aperture and a cable aperture, a cable, configured to be disposed within the cable aperture of the cable mounting portion, and a tension adjuster configured to be disposed within the adjuster aperture of the cable mounting portion and configured to urge the tension bar towards the rail.

According to yet another embodiment of the present disclosure, a method of tensioning a cable assembly is provided, the cable assembly including a rail, a tension bar including a cable mounting portion having an adjuster aperture and a cable aperture, a cable, disposed within the cable aperture of the cable mounting portion, and a tension adjuster disposed within the adjuster aperture of the cable mounting portion and configured to urge the tension bar towards the rail, the method comprising rotating the tensioner to transition the tension bar further into the cavity of the rail.

According to another embodiment of the present disclosure, a method for tensioning a cable assembly is provided that comprises inserting a tension bar including a cable mounting portion having an adjuster aperture and a cable aperture conjoined together into a cavity of a rail, inserting a crimped end of a cable into the adjuster aperture of the cable mounting portion of the tension bar, sliding the cable from the adjuster aperture to the cable aperture of the cable mounting portion of the tension bar, inserting a tension adjuster into the adjuster aperture of the cable mounting portion of the tension bar, and rotating the tension adjuster to urge the tension bar towards the rail and apply tension to the cable.

Additional features of the present disclosure will become apparent to those skilled in the art upon consideration of the following detailed description of the illustrative embodiment exemplifying the best mode of carrying out the disclosure as presently perceived.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
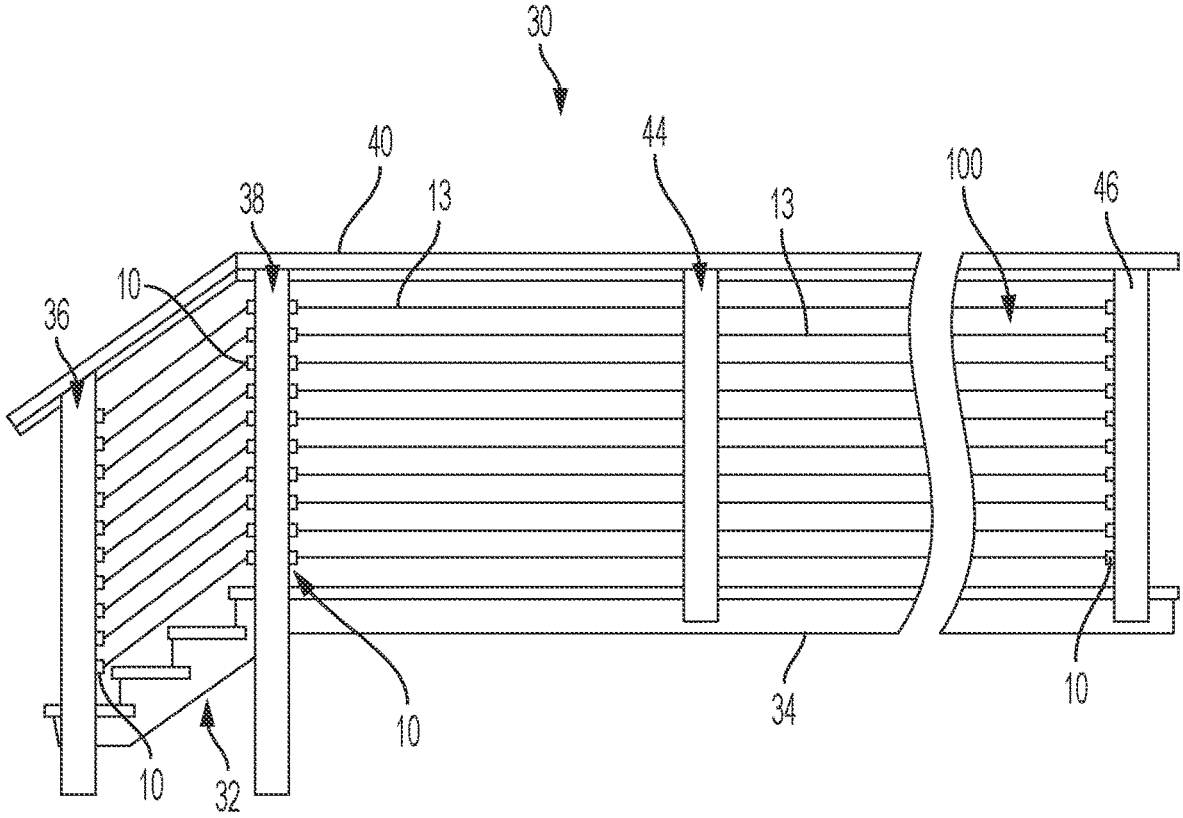
FIG. 1 is a side elevation view of a rail installed on a deck having a set of stairs and a platform, showing the rail including a plurality of posts and cable extending horizontally between the posts to form a barrier.

Corresponding reference characters indicate corresponding parts throughout the several views. Although the exemplifications set out herein illustrate embodiments of the invention, the embodiments disclosed below are not intended to be exhaustive or to be construed as limiting the scope of the invention to the precise form disclosed.

DETAILED DESCRIPTION

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Referring to FIG. 1, a deck 30 is shown having a set of steps 32 and a platform 34. Deck 30 is provided with a railing having a first end post 36, a second end post 46, a first intermediate post 38 positioned at the top of stairs 32, and a second intermediate post 44 positioned along the platform 34. An upper rail 40 extends across the tops of posts 36, 38, 44, 46, and a cable system 100 extends generally horizontally between first intermediate post 38 and second end post 46 and follows the upward slope of stairs 32 between first end post 36 and first intermediate post 38. Cable system 100 includes a plurality of cables 13 which are tensioned between the respective posts 36, 38, 44, 46, and cable tensioning systems 10 that secure cables 13 to posts the posts 36, 38 and 46 and apply the tension to cables 13.

As shown in FIG. 1, a first set of cables 13 extend partially into first end post 36 and partially into intermediate post 38 and are angled to match the incline of steps 32 and upper rail 40 positioned over steps 32. A second set of cables 30 extend partially into end post 46, completely through intermediate post 44, and partially into intermediate 38. Cables 13 are normally terminated at the end of railings or at transitions in the direction of cables 13, such as at intermediate post 38 where steps 32 meet platform 34, a corner post (not shown) of a platform 34, or other locations where cables 13 are not straight.

Figure 2:
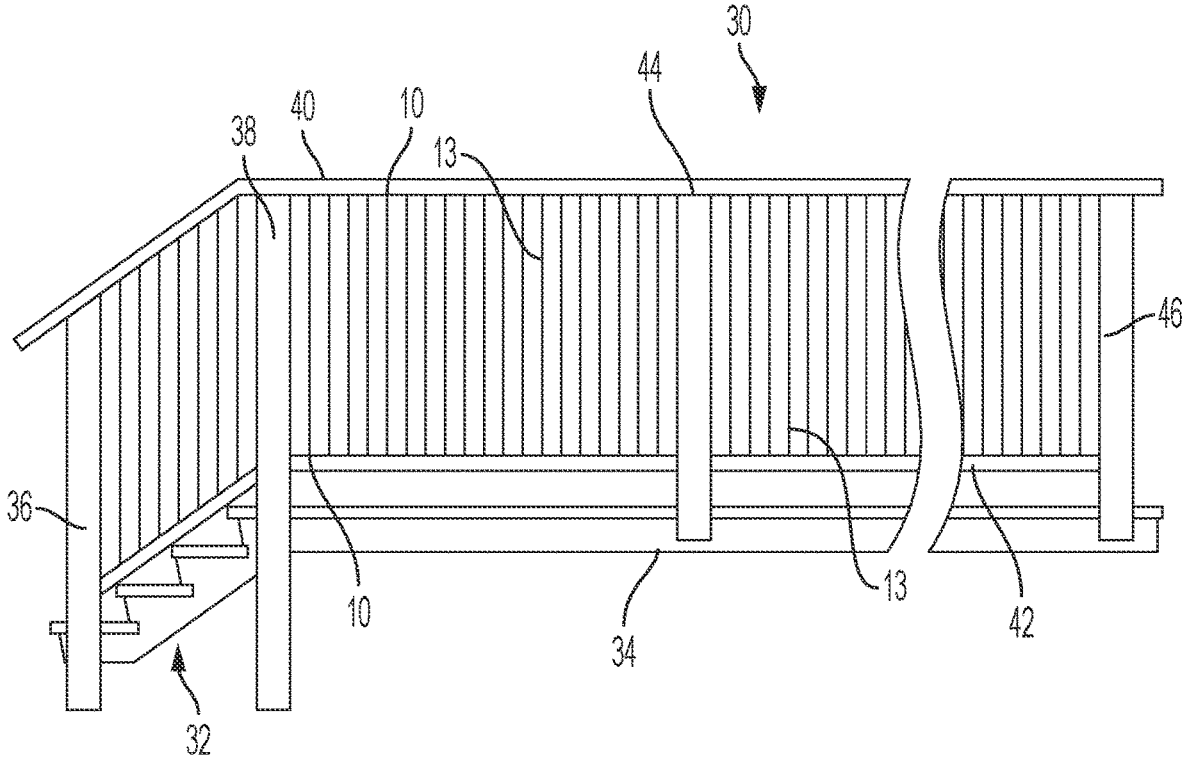
FIG. 2 is a side elevation view of a rail installed on a deck having a set of stairs and a platform, showing the rail including a plurality of posts and cable extending vertically between the posts to form a barrier using a cable tension assembly.

Alternatively, as shown in FIG. 2, cable tensioning system 10 can be used to tension cables 13 that extend vertically. Deck 30 of FIG. 2 includes the same upper rail 40 as that of FIG. 1, and also includes lower rail 42. Lower rail 42 extends horizontally along platform 34 parallel to upper rail 40. In this configuration, cables 13 extend partially into upper rail 40 and partially into lower rail 42 and terminate at upper rail 40 and at lower rail 42. Deck 30 of FIGS. 1 and 2 are just two examples of a railing and a deck. Cable tensioning assembly 10 may be used on other railing configurations or other situations that may benefit from tensioned cables, such as cables used as a barrier for human passage along a particular path or direction.

Figure 3:
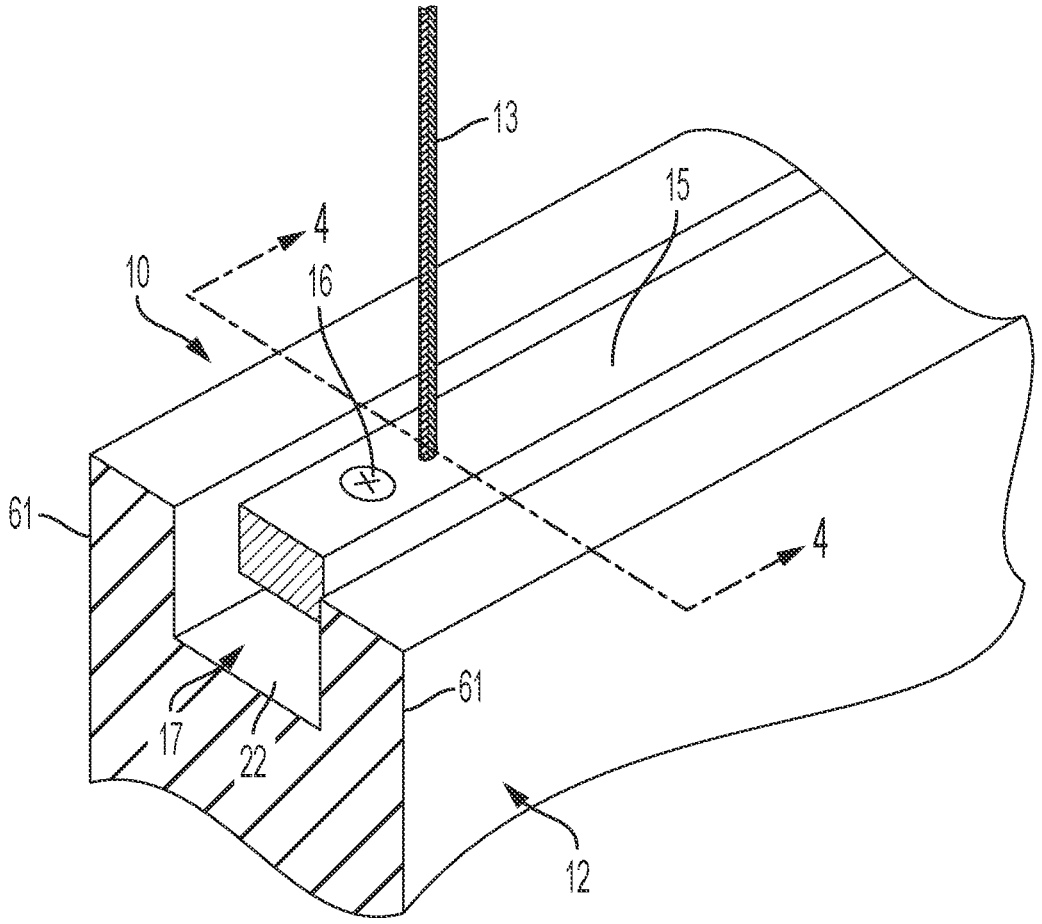
FIG. 3 is a perspective view of an embodiment of a cable tension assembly made in accordance with the present disclosure.
Figure 4:
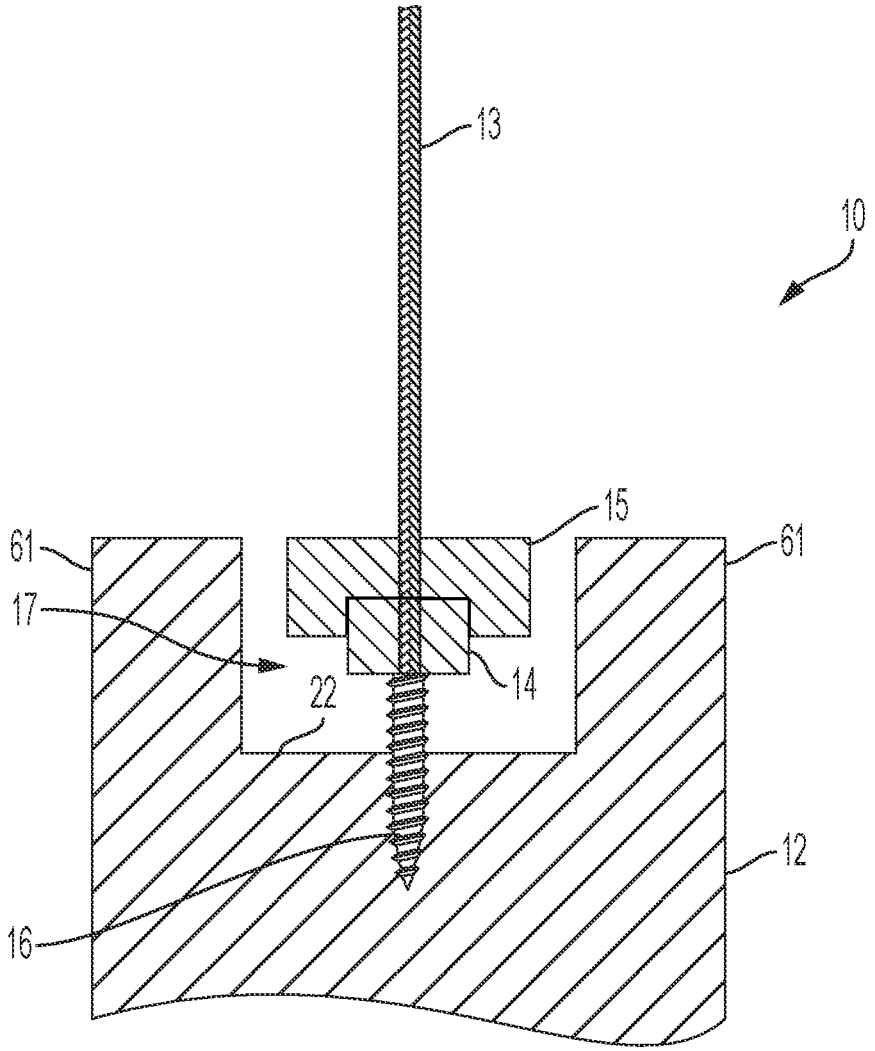
FIG. 4 is an elevation, cross-section view of the cable tension assembly of FIG. 3, shown in connection with a bottom rail, taken along a width of the assembly.
Figure 5:
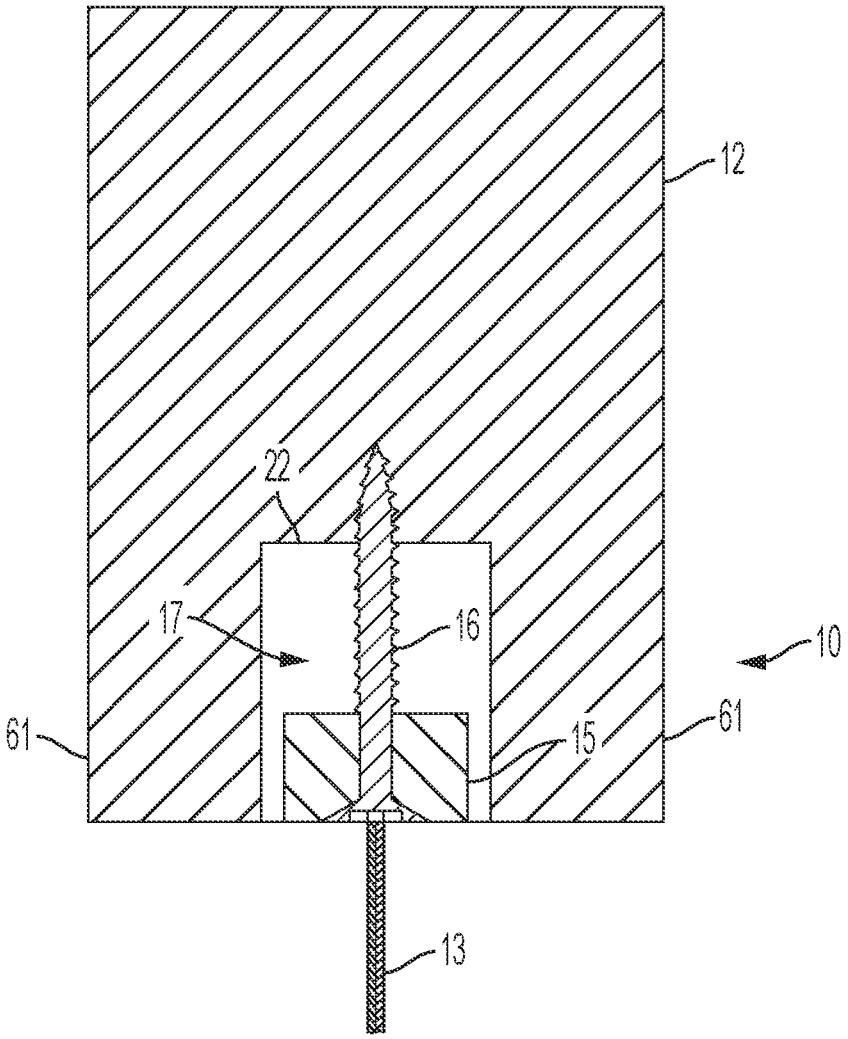
FIG. 5 is another elevation, cross-section view of the cable tension assembly of FIG. 3, shown in connection with a top rail.
Figure 6:
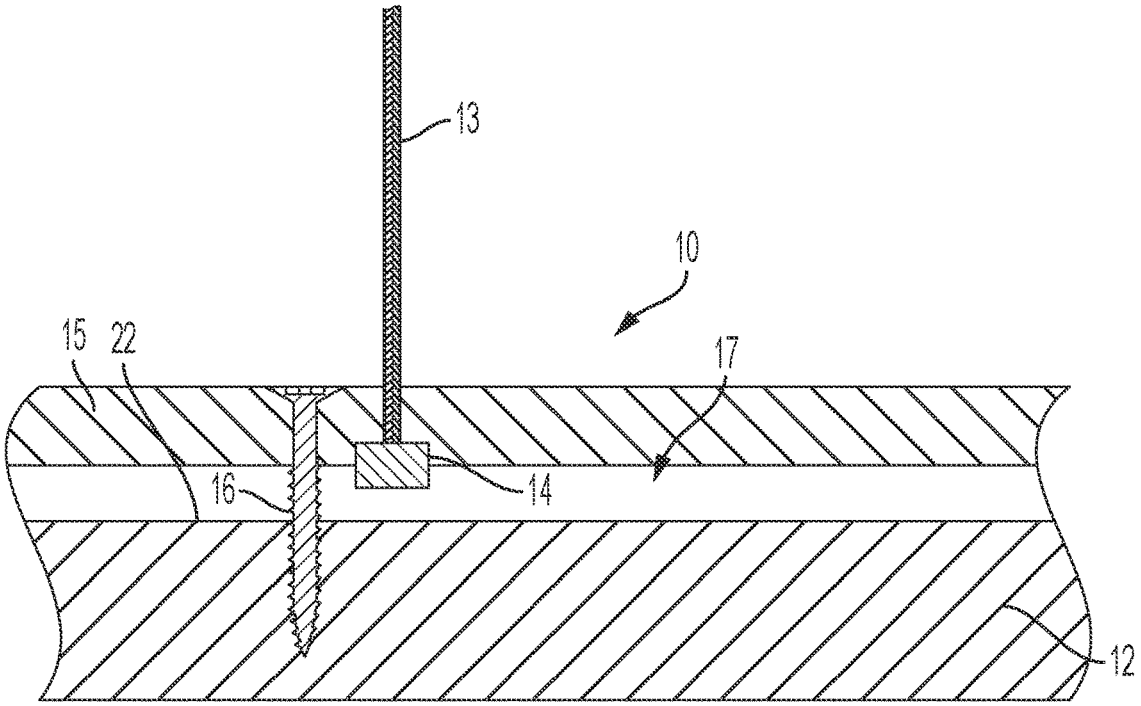
FIG. 6 is another elevation, cross-section view of the cable tension assembly and bottom rail of FIG. 4, taken along the length of the assembly.

FIGS. 3-8 show a portion of an exemplary embodiment of cable tensioning assembly 10. Cable tensioning assembly 10 includes rail 12 which can optionally include a cavity 17 defined by two side surfaces and an adjacent bottom surface 22. Assembly 10 further includes cable 13 which includes a crimped end 14, tension bar 15, and tensioner 16. Rail 12 can be used as a connection with platform 34, stairs 32, such as by being integrated into or forming a portion of rails 40, 42, or posts 36, 38, 44, 46. Rail 12 could be any shape with a flat or rounded surface that engages with tensioner 16 as further described below. The width of cavity 17 is sized to receive tension bar 15 as shown in FIG. 3.

Figure 16:
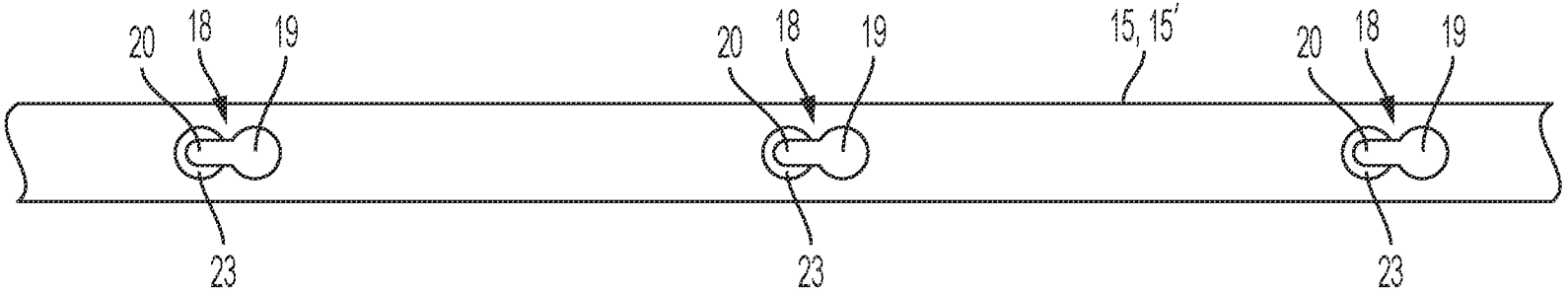
FIG. 16 is a top plan view of a tension bar as included in the cable tension assembly of FIGS. 1 and 2.
Figure 17:
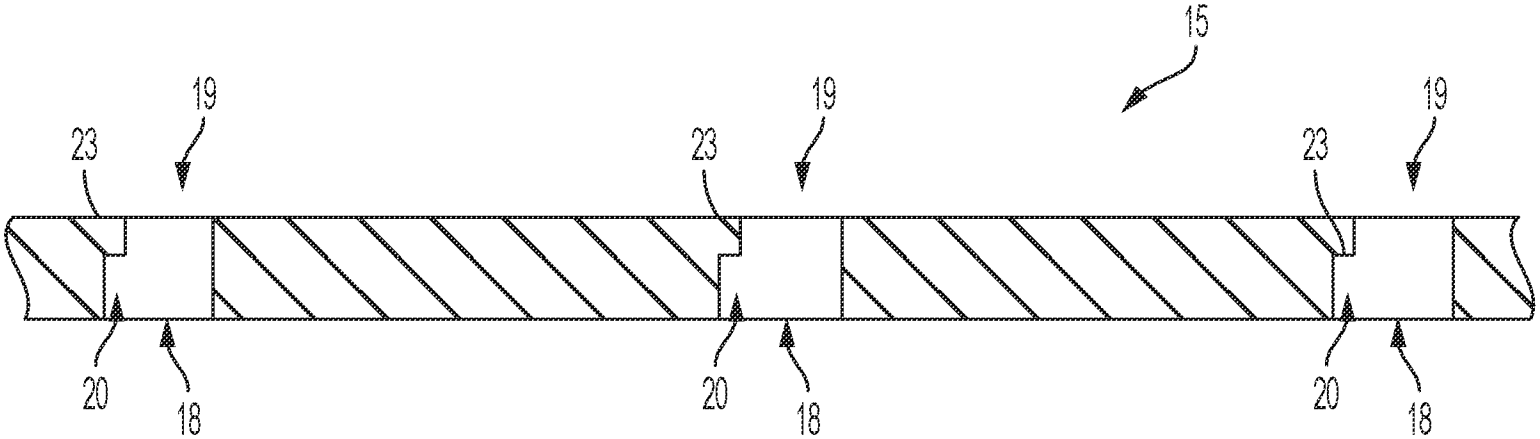
FIG. 17 is an elevation, cross-section of the tension bar forming a part of a cable tension assembly in accordance with the present disclosure.

Tension bar 15 extends at least partially along the length of rails 12 and includes a plurality of apertures. As shown by a comparison of FIGS. 16-17, 18 and 19, tension bar 15 may have several configurations in accordance with the present disclosure. In the embodiment of FIGS. 16 and 17, for example, tension bar 15 is an elongated rectangular prism (i.e., having a rectangular cross-section) with a plurality of equally spaced cable mounting portions 18. Cable mounting portions 18 each include an adjuster aperture 19 and a cable aperture 20. Each cable aperture 20 includes flanges 23 which operate to capture the crimped end 14 of cable 13, as further described below. In the illustrative embodiment of FIGS. 16-19, adjuster apertures 19 and cable apertures 20 are conjoined into a single, elongated aperture.

Alternatively, cable mounting portion 18 could include individual adjuster apertures 19 and cable apertures 20 that are separated by the material of tension bar 15. Such separate apertures may still be closely spaced (e.g., by up to two times the diameter of the larger aperture) to avoid undue torsion in the material between the apertures 19, 20.

Figure 18:
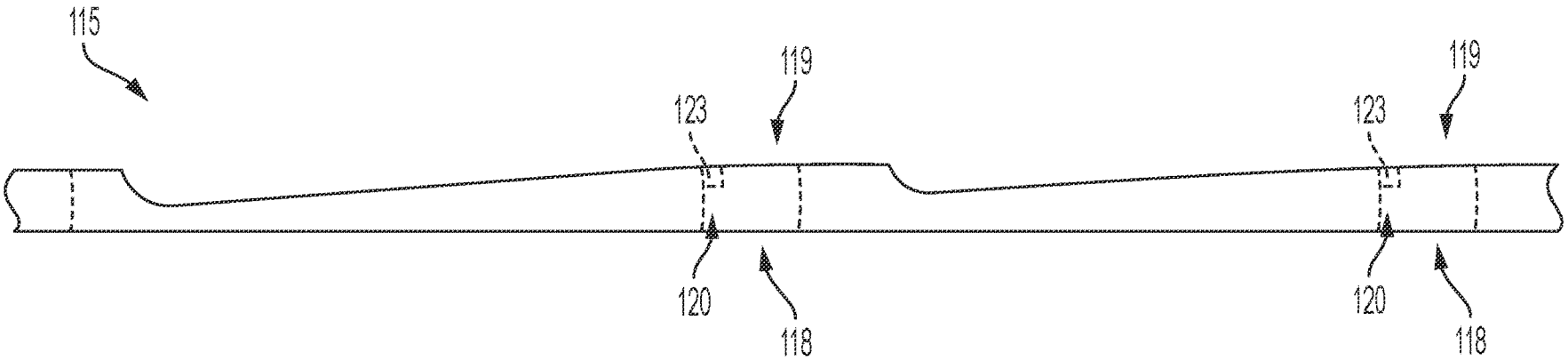
FIG. 18 is a side elevation view of another tension bar made in accordance with the present disclosure.
Figure 19:
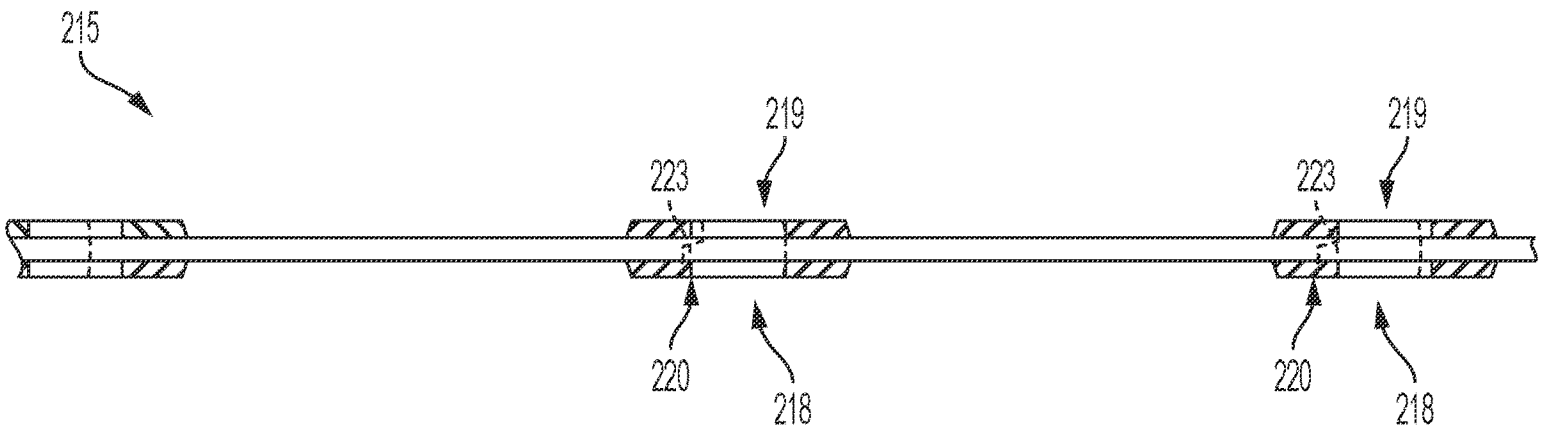
FIG. 19 is a side elevation view of yet another tension bar made in accordance with the present disclosure.

Tension bar 115 of FIG. 18 includes sloped shape that increases in thickness leading up to cable mounting portions 118. Thus, the thickness of tension bar 115 is greatest at mounting portions 118, and gradually reduces to a minimum thickness between mounting portions 118 as shown. Tension bar 215 of FIG. 19 is an elongated rectangular prism (i.e. with a rectangular cross-section) similar to tension bar 15. However, tension bar 215 includes a plurality of equally spaced apart cable mounting portions 218 which mount to the bar adjacent the apertures 219, 220 which are thickened relative to the rest of tension bar, such as by affixing a plate or washer to bar 215. Tension bars 115 and 215 are shaped to improve load distribution and to better manage the constant flex force applied to tension bars 115, 215. For purposes of the present disclosure, tension bars 15 are described in connection with the function of cable tensioning assembly 10, it being understood that tension bars 115, 215 may also be used interchangeably with tension bar 15.

As mentioned above, cables 13 can extend vertically or horizontally. Cable 13 can be anchored to one of a floor, platform 34, stairs 32, rails 40, 42, or posts 36, 38, 44, 46. From this anchor point, cables 13 can extend down or over to one of the other aforementioned structures to meet cable tensioning assembly 10. Alternatively, cable 13 can be attached to a cable tensioning assembly 10 at both ends. The end, or ends of cable 13 that is mounted to cable tensioning assembly 10 includes a crimped end 14 or another enlarged feature, which both prevents cable 13 from fraying and also to provide a thickened portion at the end of cable 13 that can be captured within aperture 20 as further described below.

Figure 7:
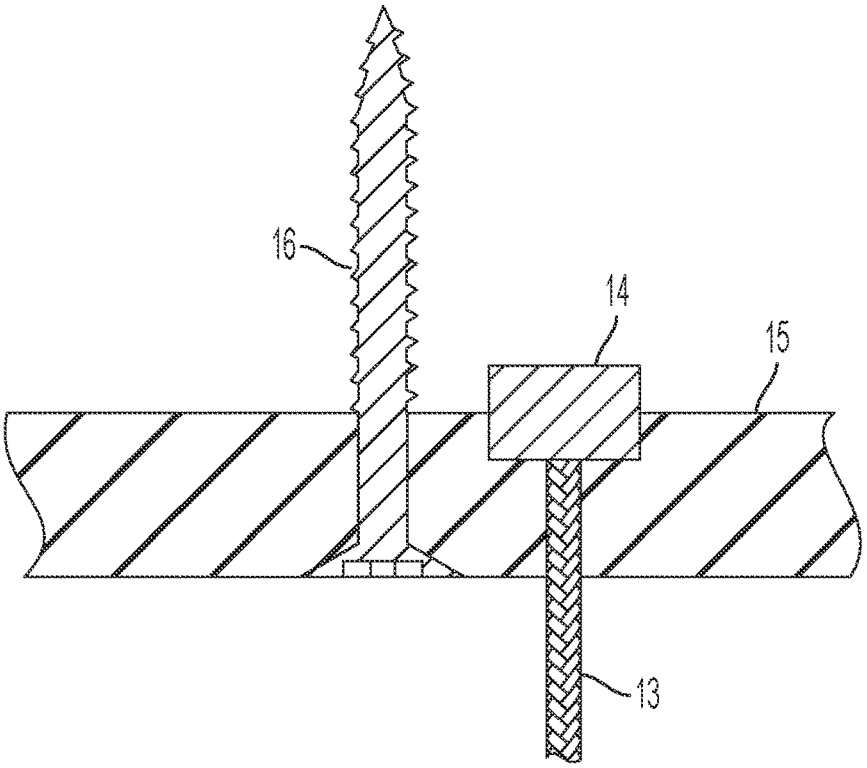
FIG. 7 is another elevation, cross-section view of the cable tension assembly and bottom rail of FIG. 5, taken along the length of the assembly.
Figure 8:
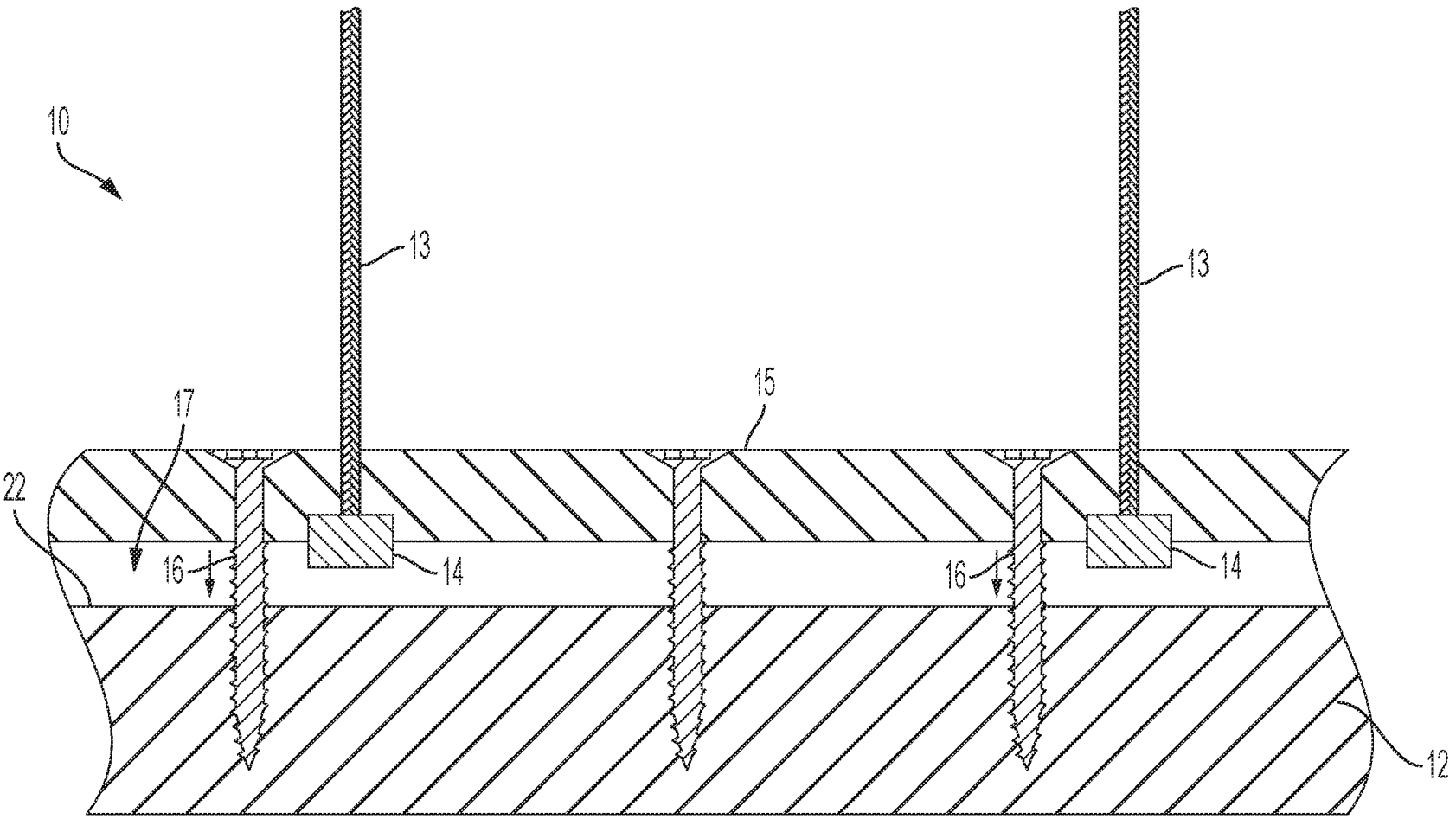
FIG. 8 is an elevation, cross-section view of the cable tension assembly shown in FIG. 6, shown with multiple adjusters and cables.

As best seen in FIG. 7, tension adjuster 16 includes a threaded portion, an unthreaded portion, and a tool engaging portion. For example, tension adjuster 16 may be a bolt with a threaded shank portion, an unthreaded shank portion, and a head adapted to engage with a tool such as a wrench or screw driver. The tool engaging portion of tension adjuster 16 has a diameter greater than the diameter of both adjuster aperture 19 and of crimped end 14 of cable 13. The unthreaded portion of tension adjuster 16 immediately follows the tool engaging portion and has a lesser diameter. The unthreaded portion of tension adjuster 16 has substantially the same length as the thickness of tension bar 15. The threaded portion of tension adjuster 16 is threaded and is longer than the unthreaded portion. Alternatively, tension adjuster 16 may have an entirely threaded shank and adjuster aperture 19 may be sized to allow the threaded portion to pass therethrough.

The installation of cable tensioning assembly 10 is described herein. The specific order of installation does not need to follow the order described herein, except as otherwise specified. To install cables 13 into platform 34, stairs 32, rails 40, 42, or posts 36, 38, 44, 46, cables 13 are cut to a length about the distance between the two attachment points through which cables 13 will extend. Next, the cut ends of cables 13 are crimped, to create crimped ends 14. Then, in the case of conjoined adjuster and cable apertures 19, 20 (e.g., as shown in FIGS. 16 and 17), crimped ends 14 of cables 13 are inserted into adjuster aperture 19 and then slid over and into cable aperture 20. When seated within cable aperture 20, crimped end 14 of cable 13 is secured within cable aperture 20 by flanges 23 (FIGS. 16 and 17). In the case of separated, non-conjoined adjuster and cable apertures 19, 20, a free (i.e., non-crimped) end of cable 13 is inserted into cable aperture 20 and is thereafter crimped to secure crimped end 14 of cable 13 in the same manner as above.

Tension adjuster 16 is then inserted into adjuster aperture 19. When inserted into aperture 19 conjoined with aperture 20 (FIGS. 16 and 17), the shank of tension adjuster 16 blocks lateral movement of cable 13 and crimped end 14 such that cable 13 cannot be removed from aperture 19. The head of tension adjuster 16 abuts the shoulder within adjuster aperture 19 and is thereby secured within aperture 19 (i.e., tension adjuster cannot pass all the way through aperture 19).

Tension bar 15 is placed near or within cavity 17 of rail 12 as shown in FIGS. 3-6. This brings apertures 19, 20 close to rail 12 such that the threaded portion of tension adjuster 16 can be aligned with and contact bottom surface 22 of rail 12. Tension adjuster 16 is aligned with a threaded aperture formed in rail 12, and a tool is engaged with the tool engaging portion of tension adjuster 16 and rotated in a tensioning direction. As it is rotated, tension adjuster 16 threadably engages with the aperture formed in bottom surface 22 of rail 12, pulling tension bar 15 towards rail 12, and applying tension to cable 13. Tension adjuster 16 may be rotated in a tensioning or loosening direction to adjust tension in cables 13. This may be done at one end of cables 13 while the other ends are fixed to a stationary structure, or tension adjustments may be performed at both ends of cables 13 where cable tensioning assemblies 10 are used at both ends. Each of cables 13 may be serially tensioned using the respective tension adjusters 16 next to the cable 13.

FIGS. 9-15 depict a second exemplary embodiment of the present cable tensioning assembly 10'. Cable tensioning assembly 10' includes the same elements of cable tensioning assembly 10, and corresponding reference numbers denote corresponding structures except with a "'" added thereto. However, cable tensioning assembly 10' is configured to use compression in tension adjuster 16', rather than tension in adjuster 16, to create tension in cables 13.

Figure 9:
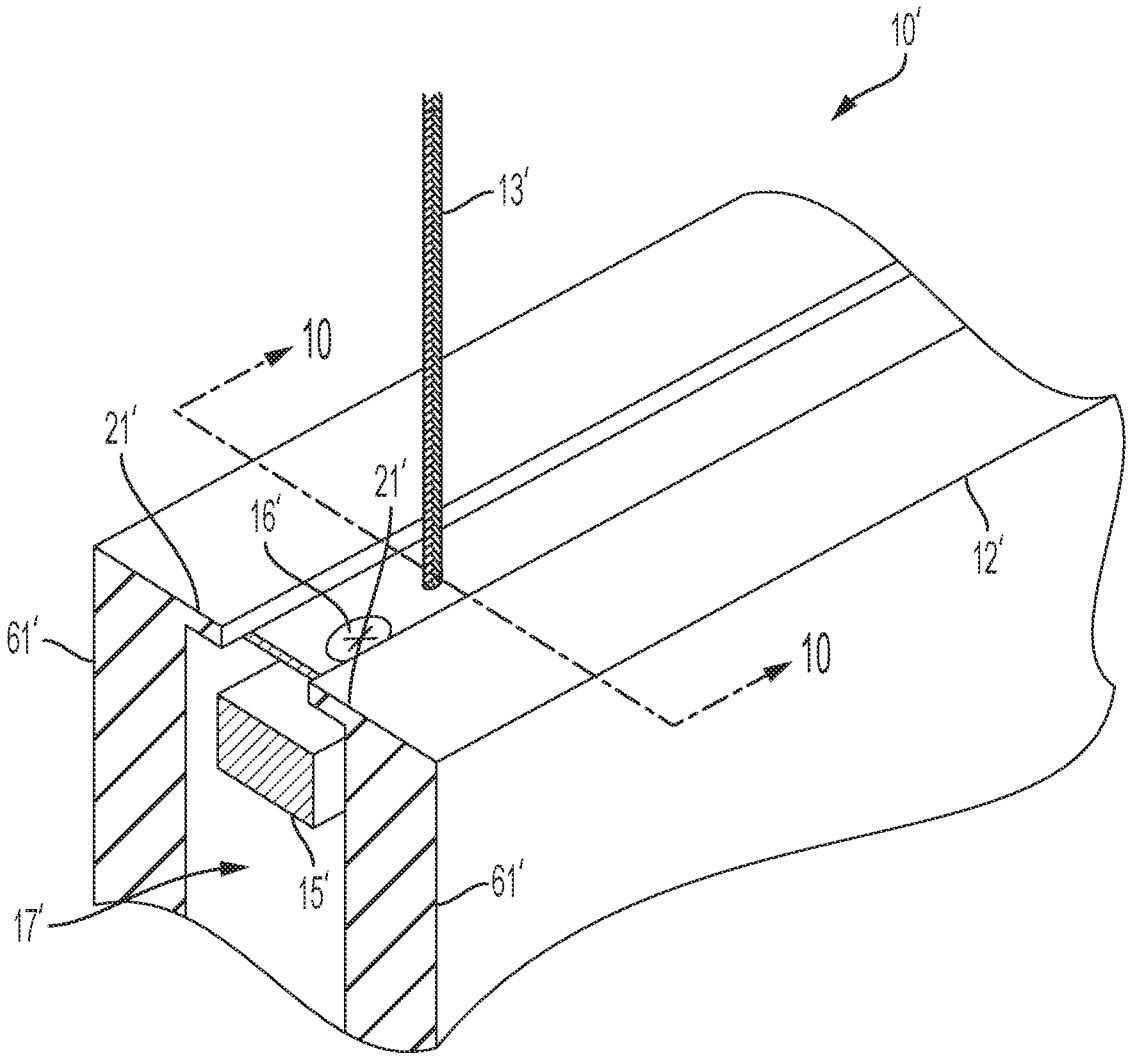
FIG. 9 is a perspective view of another embodiment of a cable tension assembly in accordance with the present disclosure.
Figure 10:
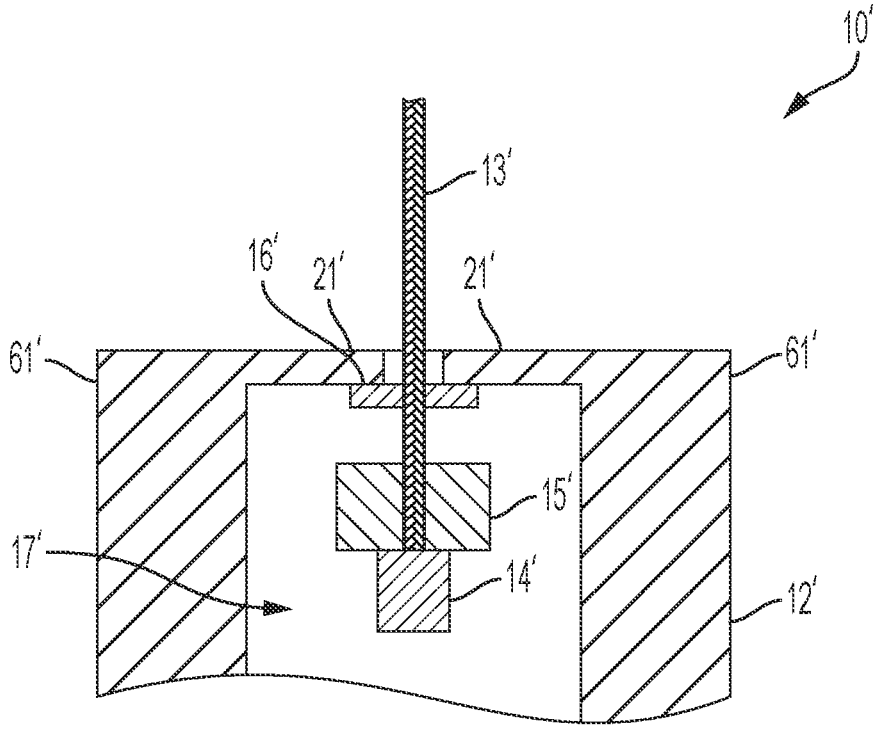
FIG. 10 is an elevation, cross-section of the embodiment of the cable tension assembly shown in FIG. 9, shown in connection with a bottom rail, taken along a width of the assembly.
Figure 11:
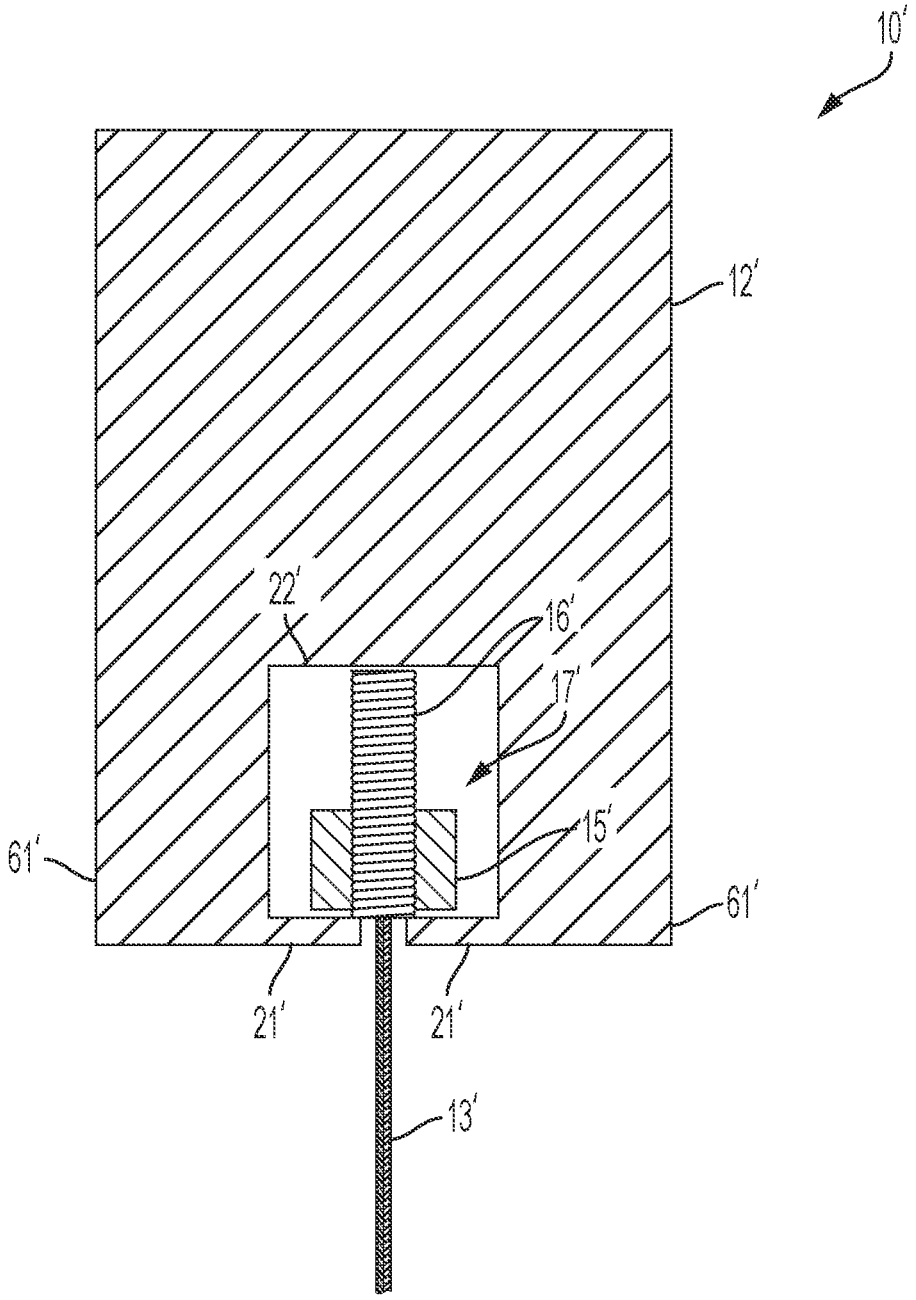
FIG. 11 is another elevation, cross-section of the embodiment of the cable tension assembly shown in FIG. 9, shown in connection with a top rail, taken along a width of the assembly.
Figure 12:
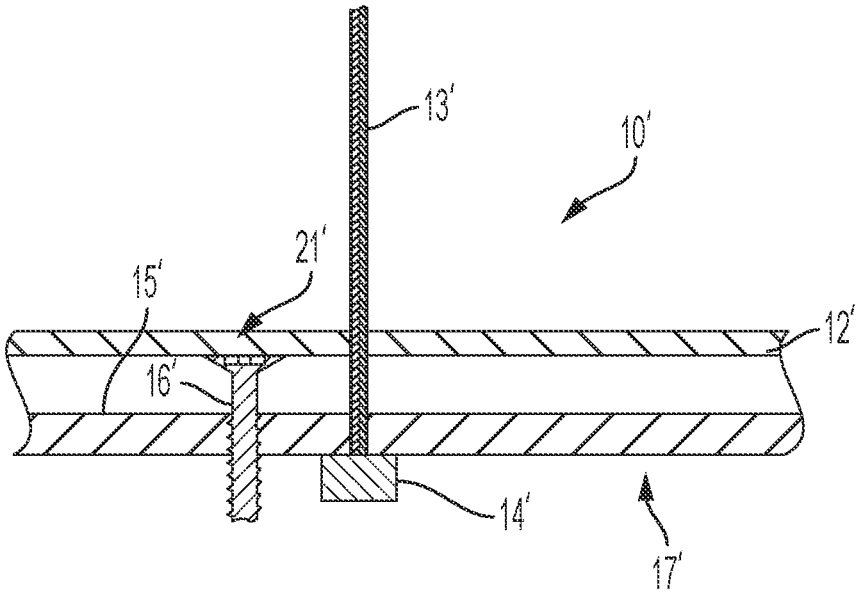
FIG. 12 is another elevation, cross-section view of the cable tension assembly and bottom rail of FIG. 10, taken along the length of the assembly.
Figure 13:
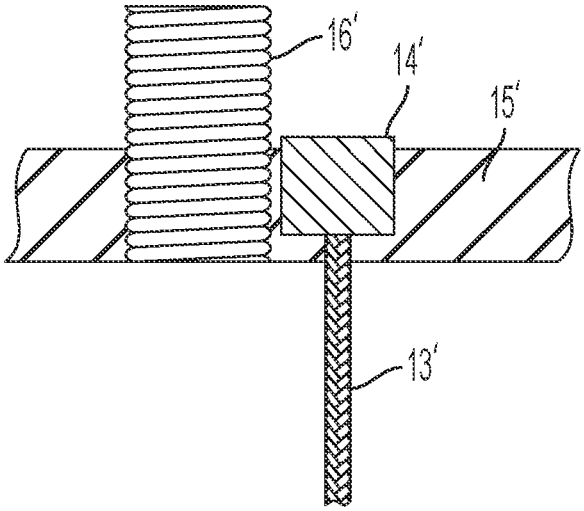
FIG. 13 is another elevation, cross-section view of the cable tension assembly and top rail of FIG. 11, taken along the length of the assembly and with a loose tension adjustment setting.
Figure 14:
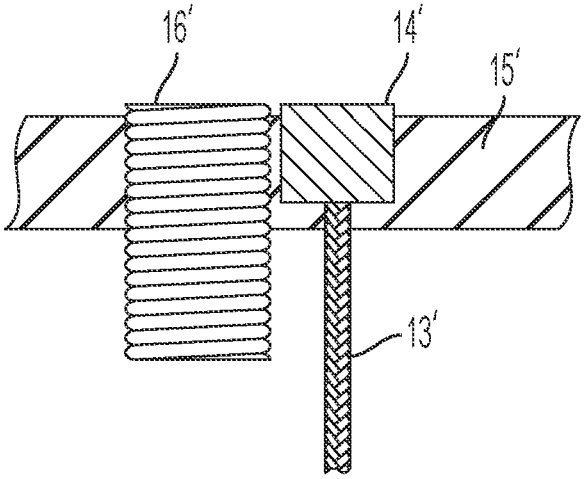
FIG. 14 is another elevation, cross-section view of the cable tension assembly and top rail of FIG. 11, shown with a tight tension adjustment setting.
Figure 15:
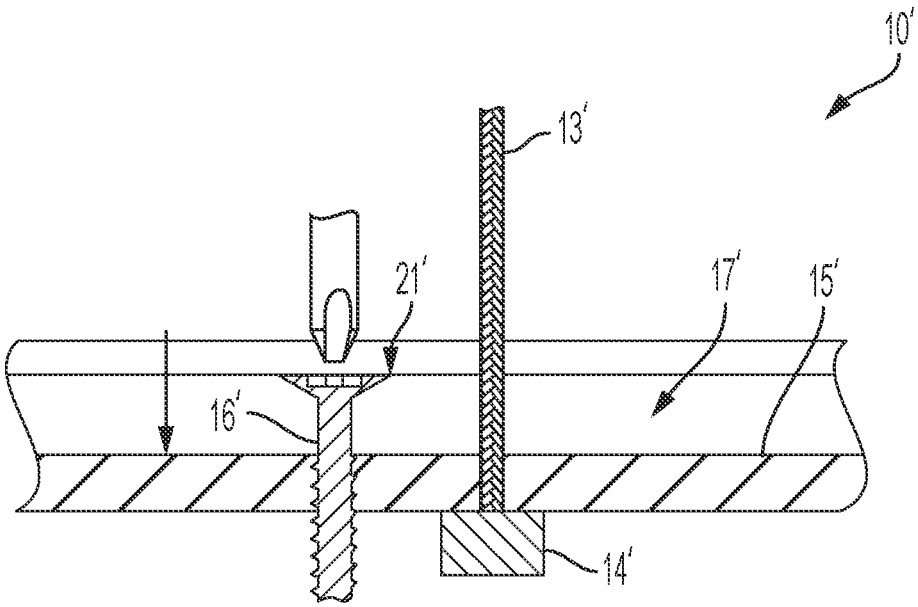
FIG. 15 is another elevation, cross-section view of the cable tension assembly and bottom rail of FIG. 10, taken along the length of the assembly and showing multiple tensioners.

In the illustrative embodiment of FIGS. 11 and 13-14, tension adjuster 16' is threaded substantially throughout its length. Adjuster aperture 19' has a correspondingly threaded inner surface configured to threadably engage with the threaded outer surface of adjuster 16'. Referring to FIGS. 9 and 11, rail 12' includes a cavity 17' defined by two side arms 61' similar to the embodiment of rail 12 described above. However, side arms 61' include flanges 21' that partially enclose cavity 17'. Tension adjuster 16' has a length short enough to fit within the distance between bottom surface 22' and flanges 21' (FIG. 11).

The assembly of cable tensioning assembly 10' is also similar to the assembly of cable tensioning assembly 10 as described above. However, tension bar 15' is slidably inserted into cavity 17' so that tension bar 15' and tension adjuster 16' are fully disposed and secured within cavity 17' by flanges 21'.

The tool engaging portion of tension adjuster 16' is a recessed feature, such as a Philips-head, flat-head or Allen-wrench recess. The outer diameter of tension adjuster 16' is sized to engaged in the inner surfaces of flanges 21', while the space between flanges 21' is large enough to allow a tool to engage with the tool engaging portion in tension adjuster 16'. Thus, the tool may be inserted into the cavity 17' and used to rotate the tension adjuster 16'. As tension adjuster 16' is rotated, it is held in its axial position by flanges 21'. The threaded engagement between tension adjuster 16' and aperture 19' causes tension bar 15' to move. When tensioning cables 13, tension bar 15' is moved towards surface 22' of rail 12', and when loosening, tension bar 15' is moved toward flanges 21'.

Tensioning assemblies 10 and 10' allow for a simple and quick job-site installation of cable railing systems. Rails 12, 12', cables 13, 13' and tension bars 15, 15' may be prepared and sized ahead of time or cut to size at the site from long lengths. Tension adjusters 16, 16' can be provided in quantity and installed upon assembly. Cables 13, 13' can have at least one of the crimped ends 14, 14' installed before job-site delivery and, where conjoined apertures 19, 20 allow for installation of an already-crimped end, both ends of cables 13, 13' may be factory-crimped, saving time and labor at the job site.

While this invention has been described as having exemplary designs, the present invention can be further modified within the spirit and scope of this disclosure. This application is therefore intended to cover any variations, uses, or adaptations of the invention using its general principles.

Further, this application is intended to cover such departures from the present disclosure as come within known or customary practice in the art to which this invention pertains and which fall within the limits of the appended claims.

What is claimed is:

1. A cable tension assembly comprising:

a rail;

a tension bar including a cable mounting portion having an adjuster aperture and a cable aperture;

a cable disposed within the cable aperture of the cable mounting portion, wherein the cable has two ends including a first end that is disposed within the cable aperture of the cable mounting portion, and a second end that is mounted to a surface spaced apart from the cable tension assembly; and a tension adjuster disposed within the adjuster aperture of the cable mounting portion and configured to urge the tension bar away from the second end of the cable such that the cable is tensioned.

2. The cable tension assembly of claim 1, wherein the cable tension assembly further comprises a second rail, a second tension bar including a second cable mounting portion having a second adjuster aperture and a second cable aperture, and a second tension adjuster disposed within the adjuster aperture of the cable mounting portion and configured to urge the second tension bar towards the second rail, and the cable has two ends spaced, apart from each other, a first end that is disposed within the cable aperture of the cable mounting portion, and a second end that is disposed within the second cable aperture of the second cable mounting portion.

3. The cable tension assembly of claim 1, wherein the cable includes an end portion that is crimped.

4. The cable tension assembly of claim 3, wherein the end portion of the cable is fixed within the cable aperture and the cable is sized to be received within the cable aperture.

5. The cable tension assembly of claim 1, wherein the tension adjuster s a rotatable fastener.

6. The cable tension assembly of claim 5, wherein as the tension adjuster rotates, the tension bar is urged towards the rail.

7. The cable tension assembly of claim 1, wherein the rail includes a cavity.

8. The cable tension assembly of claim 7, wherein the tension bar is disposed within the cavity.

9. The cable tension assembly of claim 8, wherein as the tension adjuster is rotated in a tightening direction, the tension adjuster is threaded into the rail thereby introducing tension into the cable.

10. The cable tension assembly of claim 8, wherein the cavity of the rail is partially enclosed by flanges.

11. The cable tension assembly of claim 10, wherein the tension adjuster and the tension bar are fully disposed within the cavity of the rail.

12. The cable tension assembly of claim 11, wherein a first end of the tension adjuster is captured by the flanges of the cavity, and as the tension adjuster is rotated in a tightening direction, the tension adjuster remains stationary relative to the cavity and pulls the tension bar closer to the rail.

13. The cable tension assembly of claim 1, wherein the tension bar includes at least three of the cable mounting portions equally spaced from one another.

14. A cable tension assembly comprising:

a rail;

a tension bar including a cable mounting portion having an adjuster aperture and a cable aperture;

a cable, configured to be disposed within the cable aperture of the cable mounting portion, wherein the cable has two ends, a first end that is configured to be disposed within the cable aperture of the cable mounting portion, and a second end that is configured to mount to a surface spaced apart from the cable tension assembly; and a tension adjuster configured to be disposed within the adjuster aperture of the cable mounting portion and configured to urge the tension bar away from the second end of the cable such that the cable is tensioned.

15. The cable tension assembly of claim 14 further comprising a tool configured to engage with the tension adjuster.

16. The cable tension assembly of claim 14, wherein the cable tension assembly further comprises a second rail, a second tension bar including a second cable mounting portion having a second adjuster aperture and a second cable aperture, and a second tension adjuster configured to be disposed within the adjuster aperture of the cable mounting portion and configured to urge the second tension bar towards the second rail, and the cable has two ends spaced apart from each other, a first end that is configured to be disposed within the cable aperture of the cable mounting portion, and a second end that is configured to be disposed within the second cable aperture of the second cable mounting portion.

17. The cable tension assembly of claim 14, wherein the cable includes an end portion that is crimped.

18. The cable tension assembly of claim 17, wherein, the end portion of the cable is sized to be fixed within the cable aperture and the cable is sized to be received within the cable aperture.

19. The cable tension assembly of claim 14, wherein the tension adjuster is a rotatable fastener.

20. The cable tension assembly of claim 14, wherein the rail includes a cavity.

21. The cable tension assembly of claim 20, wherein the tension bar is sized to fit within the cavity.

22. The cable tension assembly of claim 21, wherein the cavity of the rail is partially enclosed by flanges.

23. The cable tension assembly of claim 22, wherein the tension adjuster and the tension bar are configured to be fully disposed within the cavity of the rail.

24. The cable tension assembly of claim 14, wherein the tension bar includes at least three of the cable mounting portions equally spaced from one another.

25. A cable tension assembly comprising:

a rail including a cavity partially enclosed by flanges;

a tension bar disposed within the cavity and including a cable mounting portion having an adjuster aperture and a cable aperture;

a cable disposed within the cable aperture of the cable mounting portion; and a tension adjuster disposed within the adjuster aperture of the cable mounting portion and configured to urge the tension bar away from the second end of the cable such that the cable is tensioned, wherein the tension adjuster and the tension bar are fully disposed within the cavity of the rail, and wherein a first end of the tension adjuster is captured by the flanges of the cavity, and as the tension adjuster is rotated in a tightening direction, the tension adjuster remains stationary relative to the cavity and pulls the tension bar closer to the rail.

* * * * *